US008915282B2

(12) United States Patent
Stoiber et al.

(10) Patent No.: US 8,915,282 B2
(45) Date of Patent: Dec. 23, 2014

(54) LABELLING ASSEMBLY

(71) Applicant: Krones AG, Neutraubling (DE)

(72) Inventors: Christian Stoiber, Michelsneukirchen (DE); Josef Scheck, Mangolding (DE)

(73) Assignee: Krones AG, Neutruabling (DE)

( * ) Notice: Subject to any disclaimer, the term of this patent is extended or adjusted under 35 U.S.C. 154(b) by 228 days.

(21) Appl. No.: 13/723,779

(22) Filed: Dec. 21, 2012

(65) Prior Publication Data

US 2013/0168026 A1 Jul. 4, 2013

(30) Foreign Application Priority Data

Dec. 30, 2011 (EP) ..... 11196197

(51) Int. Cl.
*B65C 9/10* (2006.01)
*B65C 9/00* (2006.01)
*B65C 9/16* (2006.01)

(52) U.S. Cl.
CPC ..... *B65C 9/10* (2013.01); *B65C 9/0062* (2013.01); *B65C 9/105* (2013.01); *B65C 9/16* (2013.01)
USPC ..... 156/538; 156/556

(58) Field of Classification Search
CPC ..... B65C 9/00; B65C 9/0062; B65C 9/10; B65C 9/105; B65C 9/16
USPC ..... 156/538, 556
See application file for complete search history.

(56) References Cited

U.S. PATENT DOCUMENTS

| | | | | |
|---|---|---|---|---|
| 3,736,213 | A | 5/1973 | Jorss et al. | |
| 3,767,515 | A | 10/1973 | Eder | |
| 4,445,961 | A | 5/1984 | Kronseder et al. | |
| 4,512,842 | A | 4/1985 | Schneider | |
| 4,770,357 | A * | 9/1988 | Sander et al. | 242/400.1 |
| 5,286,333 | A | 2/1994 | Orlandi | |
| 5,545,286 | A * | 8/1996 | Schaupp | 156/570 |
| 2004/0099379 | A1 * | 5/2004 | Erich | 156/567 |
| 2005/0153427 | A1 * | 7/2005 | Eder et al. | 435/287.1 |
| 2009/0301662 | A1 * | 12/2009 | Ferri et al. | 156/538 |

FOREIGN PATENT DOCUMENTS

| | | | |
|---|---|---|---|
| DE | 3121694 | A1 | 2/1983 |
| DE | 3304191 | A1 | 8/1984 |
| DE | 4004356 | A1 | 8/1991 |
| DE | 4042100 | A1 | 9/1991 |
| DE | 20115720 | U1 | 8/2002 |
| DE | 202005007470 | U1 | 7/2005 |

(Continued)

*Primary Examiner* — Philip Tucker
*Assistant Examiner* — John Blades
(74) *Attorney, Agent, or Firm* — Marshall, Gerstein & Borun LLP

(57) ABSTRACT

A labelling assembly with a transfer module that has a rotationally driveable hub at least of one essentially vertical pallet shaft, to which transfer module it is possible to allocate functionally an at least essentially vertical glue roll, at least one label magazine and a gripper cylinder that can be driven rotationally around an at least essentially vertical axis, and where at least the pallet shaft and/or the magazine and/or the gripper cylinder and/or the glue roll is a removable replacement fitting or are removable replacement fittings connected detachably to a respective support for a replacement due to retooling. Further, a connection of at least one replacement fitting with its respective support is formed in such a manner that the replacement fitting can be removed and attached by means of an essentially, to the greatest possible extent, horizontal and lateral relative movement of the replacement fitting.

37 Claims, 4 Drawing Sheets

(56) References Cited

FOREIGN PATENT DOCUMENTS

| | | | |
|---|---|---|---|
| DE | 102004054057 | A1 | 8/2005 |
| DE | 19758799 | B4 | 3/2008 |
| DE | 102007054729 | A1 | 5/2009 |
| EP | 0368011 | A1 | 5/1990 |
| EP | 1939095 | A1 | 7/2008 |
| GB | 2431704 | A | 5/2007 |
| WO | WO-9941513 | A1 | 8/1999 |
| WO | WO-03029083 | A1 | 4/2003 |
| WO | WO-2011074019 | A1 | 6/2011 |

* cited by examiner

LABELLING ASSEMBLY

CROSS-REFERENCE TO RELATED APPLICATION

The present application claims the benefit of priority of European Application No. 11 196 1797.5, filed Dec. 30, 2011. The entire text of the priority application is incorporated herein by reference.

FIELD OF THE DISCLOSURE

The present disclosure relates to a labelling assembly, such as of the type used for the continuous labelling of containers.

BACKGROUND

In filling technology, it is known to furnish containers with individual label fittings, that can be pre-cut printed paper or plastic parts, pre-cut tinfoil parts, logos or relief-like structures, and, for example, that are applied on to the container surface with the use of cold glue. Because by all means more than 50,000 containers an hour and more must be labelled, highly developed labelling assemblies that are allocated functionally to a rotary table that conveys the containers to be labelled past are used for this purpose. In the same labelling assembly, it is possible to process simultaneously different label fittings at different levels, such as, for example, a body label for the container body, a neck label for the container neck, or the like. A change in the type of label and/or a change in the dimensions of the containers that are to be labelled and/or a change in the division of the container conveyance during labelling requires that the labelling assembly be retooled due to the geometric circumstances given in the labelling assembly. For this purpose, different replacement fittings are held available for the labelling assembly, whereby these are suitable for different working conditions and are interchangeable with respect to one another. The aforementioned high labelling frequencies are possible only with containers that rotate as they are conveyed while in an upright position, as a result of which the rotational axes of components working in the labelling assembly likewise have to be at least essentially vertically oriented. The replacement fittings are thereby mounted in the labelling assembly in such a manner that a replacement necessitates that each replacement fitting be lifted over a considerable axial path during the removal and then moved away upwards and/or to the side, and when being inserted again, in turn introduced from the side or from the top and threaded over the long axial path. Since ancillary lifting devices cannot be used because there is usually very restricted access in the labelling assembly at the top, retooling jobs must be carried out manually by operators, whereby, because of the considerable weight of each fitting piece, the large number of different fitting pieces and, above all, the long vertical lifting and lowering movement paths, this is extraordinarily arduous and non-ergonomic.

Consequently, in the case of the labelling assembly known from U.S. Pat. No. 3,736,213, each pallet shaft must be pulled out and lifted away to the side after an upper support is removed or pivoted away vertically upwards from a coupling box of a lantern wheel lying underneath. The glue cylinder that is driven from below can also only be lifted out upwards. The same can be said for the gripper cylinder, which can be rotated around a stationary vertical pivotal mounting that, because of the necessity of possibly labelling in a plurality of levels, extends far upwards, and that therefore must be lifted and lowered very far vertically.

In the labelling assembly known from DE 32 16 138 A, each pallet shaft must be lifted vertically a long way upwards from a coupling box of the lantern wheel that is arranged underneath after an upper support has been pivoted away, in order to detach an engagement between a polygonal end of the pallet shaft and the coupling box. This is also true for the glue roll that is driven from underneath and just as true for the gripper cylinder. The magazine in which the labels are held ready in a stacked manner for the transfer is also normally threaded from above on to vertical support columns and supported in such a manner that lateral reactive forces from the label take-over can be absorbed easily, and that the magazine remains positioned properly. Because magazines are frequently positioned one above the other in a plurality of levels, these vertical support columns are correspondingly high, which necessitates that the large weight of, particularly, full magazines, be lifted up a far distance and then carefully lowered in a controlled manner over the support columns, or that the still considerable weight of each empty magazine be lifted vertically over a long movement path. This construction and handling of the replacement fittings, which has meanwhile become standardized over the decades, is ergonomically disadvantageous and user-unfriendly with respect to a fitting replacement, and is critical with regard to occupational safety regulations, for example, also for women, and results in relatively long replacement times.

SUMMARY OF THE DISCLOSURE

One aspect of the disclosure is the fashioning a labelling assembly of the type mentioned at the beginning of the disclosure with regard to a replacement of replacement fittings in a manner that is ergonomically advantageous and user-friendly.

Because the connection of the at least one replacement fitting with the associated support is formed in such a manner that the connection can be detached and manufactured by means of an essentially, to the greatest possible extent, horizontal and lateral relative movement only of the replacement fitting with respect to the support, there is no longer a need to lift or lower the replacement fitting a considerable height during a replacement. It is rather the case that the replacement fitting that is released by the essentially, to the greatest possible extent horizontal and lateral relative movement can be lifted away conveniently or transferred immediately to a support, such as a replacement truck or the like. This is ergonomically favorable and user-friendly, and also results in shortened replacement times.

In the case of an expedient embodiment, the connection that is to be detached for a replacement or to be manufactured after a replacement is a rotating joint, by means of which a torque and/or rotational movements can be transmitted during the operation of the labelling assembly, and that can be disengaged and engaged by means of a horizontal lateral tipping movement of the replacement fitting. A horizontal lateral tipping movement means that an operator faces a far lower load than when lifting or lowering the weight of the replacement fitting for a substantial height and in a vertical direction. The replacement fitting can namely be transferred with the tipping movement immediately to a support that is kept ready, and then transported away without the operator having to bear or lift the total weight. This also applies in the opposite case, for the insertion or manufacture of the connection, because after the positioning of the replacement fitting on the rotating joint, during the subsequent horizontal and lateral tipping movement and until the complete engagement of the rotating joint, the weight of the replacement fitting is already supported partially via the rotating joint. The joint can have a frontal force fit and/or form fit.

In the case of a particularly expedient embodiment, the respective rotating joint is a Hirth coupling, which has been known in many areas of technology for decades as an easily detachable coupling that transmits a torque, and particularly in areas in which the idea is to be able to engage and disengage the Hirth rotating joint easily under restricted space conditions by means of only a tipping movement.

The rotating joint expediently has two frontal toothed rings, preferably designed to be of the same type, that pass one inside the other and that can be engaged and disengaged by means of a relative tipping movement of one joint half laterally towards the joint axis and that allow high turning moments to be transmitted when in their fully mutually engaged position.

A particularly important aspect of the rotating joint is that, in addition to its easy tipping detachability and ability to engage in a tipping engageability, it is formed as a centering device between the shafts that are to be coupled, so that the shafts that are to be coupled to each other are properly centered with respect to each other solely by the manufacture of the full engagement position. Because a centering device could also be formed by means of centering parts that interlock axially, but that would, in the case of a vertically standing replacement fitting of a labelling assembly, in turn require a substantial lifting movement, the self-centering of the rotating joint solely by means of the tipping rotating joint engagement movement is a significant advantage that requires no considerable lifting or lowering of a heavy replacement fitting.

Because an important factor in the case of replacement fittings of a labelling assembly is very frequently that a mutual specific rotational positioning is to be maintained in the connection between the shafts that are to be coupled, a further important aspect of the disclosure lies in the fact that the rotating joint that is used can be brought, particularly without play, into the full engagement position in only a single relative rotational positioning between the shaft and the drive shaft, because tooth play in the circumferential direction could severely impair the subsequent proper transmission of the torque or of the rotational movements.

In the case of an expedient embodiment, each frontal toothed ring is arranged such that it is concentric with the axis of the rotating joint around a central free area which, preferably, can be spherical. This results in advantages for the rotating joint from a manufacturing point of view, and takes into account the phenomenon of mechanics, according to which large turning moments between cogged frontal toothed rings are best transmitted on a largest possible diameter. The interior free area furthermore offers the advantage of being able to accommodate further components that, for example, can be used for the axial securing of the engaged rotating joint.

In order to be able to engage or disengage the rotating joint with a lateral tipping movement, to center perfectly with respect to each other the shafts that are coupled in the full engagement position, and to ensure that there is only a single predetermined relative rotational positioning in the rotating joint, it can be expedient if each frontal toothed ring has, in the circumferential direction, irregularly distributed teeth and tooth spaces, whereby the teeth and at least some of the tooth spaces have diagonal flanks and ridges in the radial and axial directions. The distance, measured in the circumferential direction, between the diagonal flanks of each tooth preferably increases in the axial direction symmetrically in the direction towards the tooth root. In the radial direction inwards, at least one section of the tooth ridge drops away diagonally in the direction towards the tooth root. Also conceivable are equal teeth or tooth spaces regularly distributed on the frontal toothed rings in the circumferential direction and at least one additional positioning device for only one predetermined engagement position between the two frontal toothed rings. This could be, e.g., a centering pin on one frontal toothed ring and a receiving element for the centering pin in another frontal toothed ring.

In order to ensure that the replacement fitting is positioned properly by means of the rotating joint before or after a replacement and that it does not independently tip to the side in an uncontrolled manner, or that during operation, the forces that arise during the torque transmission via the diagonal tooth flanks do not separate the rotating joint in an uncontrolled manner, in a further embodiment a force-fit and/or form-fit axial securing element is provided in the rotating joint between the frontal toothed rings at least in the full engagement position.

With regard to high ergonomic quality and user-friendliness for a replacement of a replacement fitting, here a magnetic axial securing element can be provided that can be changed between holding and release positions exclusively by the essentially horizontal and lateral tipping movement of the replacement fitting during the removal or mounting and that takes on and holds automatically the holding position via magnetic forces in the full engagement position. The holding effect of this magnetic axial securing element needs to be only relatively weak, so that an operator is easily able to prepare the rotating joint for disengagement solely by means of the lateral tipping movement, without having to lift the weight of the replacement fitting.

In an alternative embodiment, on the other hand, a magnetic axial securing element can be expedient whose magnet or counterpart is brought from the holding position and into the release position before the removal of the replacement fitting via a connection element with a low expenditure of energy, so that during the removal of the replacement fitting, the operator does not have to manufacture the release position with a manual force. The holding position is likewise manufactured after the insertion of the replacement fitting by means of activating the connection element.

In a further embodiment, a form-fit and force-fit axial securing element is provided that, however, requires that the form-fit axial securing element be brought into the release position before the disengagement of the rotating joint, and that it be adjusted back into the holding position after the insertion in the full engagement position of the rotating joint and before resuming operation again. This can be brought about, for example, with a clamping screw that fixes the rotating joint in place in the engagement position, or by means of wedge-shaped locking elements that are activated by an axial rotational movement and that can be slid axially, or via a bayonet coupling that requires a rotational and pulling movement via a corresponding activation element. A form-fit axial securing element can preferably be used if a replacement fitting that is connected on only one end, or a high replacement fitting that possibly is operated without upper support, for example, a gripper cylinder, is positioned via the rotating joint.

In order to make it possible to accomplish the removal or insertion of at least one magazine or a magazine carrier in an ergonomically favourable and user-friendly manner, in a further embodiment, it is provided to manufacture each connection between the magazine or the magazine carrier and a support that is stationary with respect to the same (without turning moment transmission) by means of a cone pin that is inserted into a cone sleeve, whereby the reciprocal axial engagement depth corresponds to only roughly the average engagement diameter or is less than this, and whereby the cone tip angle of the cone pin amounts to between roughly 5° and 15°. The magazine or the magazine carrier, as a replacement fitting, therefore no longer needs to be lifted or lowered across a long vertical movement path, and instead only over the relatively slight engagement depth between the respective cone pin and the cone sleeve, whereby the relatively acute conical tip angle guarantees a perfect and stable fit so that lateral reaction forces from the take-over of the labels can also be absorbed without problems, and a proper relative positioning of the magazine is ensured.

Because the magazine or magazine carrier can be a replacement fitting that has dimensioning that is substantial in the transverse direction, it is expedient if a plurality of such connections, each with a cone pin and a cone sleeve, are provided in the circumferential direction, so that the magazine is supported stably across a large area. It can thereby be expedient if, in at least one such connection, between the cone pin and the cone sleeve an, e.g., axial magnetic securing element is effective in the full engagement position, whereby an operator is able to overcome said securing element by means of the application of a slight force during a replacement, and whereby said securing element takes on its holding position automatically during the insertion, as soon as the full engagement position has been reached.

Because frequently a plurality of magazines or magazine carriers are to be stacked in levels that are one above the other, it is expedient to provide such easily detachable connections between each pair of magazines or magazine carriers, whereby each such connection requires only a very small lifting out or setting down movement. In each case, the upper magazine or magazine carrier can be removed from and positioned on the one underneath it by means of at least one cone pin/cone sleeve. Stable support and positioning result for all via the relatively acute conical tip angle and the plurality of connections, even in the case of a plurality of magazines, one stacked above the other, whereby each upper magazine can be lifted up easily without endangering the connection between magazines lying below it, because these remain held in the engagement position by means of the magnetic axial securing elements and the loading magazine weight.

In an expedient embodiment of the labelling assembly in which the pallet shafts constitute replacement fittings, the transfer module hub, which supports a plurality of pallet shaft-rotating joint halves that are coupled to a shared lantern wheel in a manner that allows rotation, is in a drive connection with a direct drive motor, preferably an electric torque motor, that is mounted on the bottom side of a stationary support structure, said direct drive motor having a stationary, coil-containing stator and interior, magnet-equipped ring armature. The torque motor directly drives the hub, the lantern wheel and, via the lantern wheel, the pallet shafts in the hub, which, as is known per se, can also be switched off individually during operation. This construction with the direct drive motor saves substantial overall height in the area of the lantern wheel, avoids a toothed wheel drive configuration, and therefore allows the convenient pre-assembly and functional inspection of solely the functional unit of the transfer module.

The configuration of the transfer module can be fashioned in a simple and economical manner, particularly due to the omission of a cast gearbox housing construction, if the hub is rotatably and centrally supported in the support structure in a centrally unbound manner but in the area of its outer circumference via a bearing-ring-free four-point moment support element. The support structure for the rotatable support of the hub and for mounting of the direct drive motor can be a simple steel plate. The bearing-ring-free four-point moment support element reduces the overall height and constructed space in the diameter direction. The lantern wheel can be mounted conveniently on the steel plate, between the direct drive motor and the support structure, partially also such that it engages into the hub from below.

In the case of an expedient embodiment, each pallet that is suitable for the pallet shaft is manufactured from plastic, particularly due to weight and cost considerations. The pallet is preferably a two-component injection molded part. For the purpose of selective reduction of the pallet surface that is to be coated with glue, this surface is provided with a varying groove structure, for example and preferably, by means of producing, using laser ablation, recesses in an orderly pattern between straight ridges that overlap one another, so that glue is applied by the glue roll only on to the ridges.

Furthermore, due to weight considerations, the pallet shaft can expediently have a pipe-like cross-section, at least in sections. In order to ensure, without complex auxiliary materials, the respective correct rotational positioning of a pallet mounted on the pallet shaft regardless of its height position along the pallet shaft, it can furthermore be expedient to fashion the pallet shaft, at least in sections, with a non-circular outer cross-section, that can be, for example, approximately triangular (with rounded angles).

A high level of shape stability with minimized weight can be achieved for the replacement fitting of the pallet shaft by means of forming the pallet shaft as a carbon fiber enforced molded part or stainless steel hydroform pipe part and, preferably, whereby the pallet shaft bears a rotating joint half of the rotating joint on the lower end on a ring flange.

In the case of a further embodiment of the labelling assembly, in which the gripper cylinder is designed as a replacement fitting, the assembled gripper cylinder is in a drive connection, via at least one rotating joint, with a drive shaft of a direct drive motor that is mounted on the bottom of a support structure, preferably on a support structure that is shared by the gripper cylinder and the at least one transfer module, whereby the gripper cylinder is mounted on the support structure in a manner that allows rotation. The direct drive motor is expediently an electric servomotor. This construction allows convenient pre-assembly of the functional unit of the gripper cylinder. The rotating joint makes it possible to remove or attach the gripper cylinder with an essentially solely lateral and horizontal tipping movement, without having to lift it vertically over a substantial height. A plurality of rotating joints are possibly provided between the direct drive motor and the gripper cylinder, for example, in order to make it possible to adjust the desired height above the support structure of the gripper cylinder or its grippers via intermediate spacing elements and to change conveniently the height in the event of a replacement.

In the case of an economical and expedient solution, the glue roll or a glue station, the at least one transfer module, the gripper cylinder and the magazine or the magazines are arranged in the labelling assembly on a common support structure that is formed as a plate, whereby, if each is a replacement fitting, each replacement fitting is mounted in a detachable manner via a connection that can be detached and manufactured conveniently by means of only an essentially horizontal lateral relative movement of the replacement fitting.

In the case of a further expedient embodiment, the glue roll is not driven from below, as is customary, but instead is supported, in a suspended and overhung manner that allows rotation, on its top end that lies above the support structure in a mounting that is supported on the support structure, and is in a direct drive connection with an electric servomotor placed on to the top of the mounting. This compact construction ensures that spilled glue does not represent a hazard for the mountings or drive connections. The direct drive motor, particularly an electric servomotor, allows precise rotational speed regulation of the glue roll, for example, for exact synchronization with the movement of the surface of the pallet as it moves past, i.e., in precise adjustment to a varying speed profile of the movement of the surface of the pallet. If the glue roll is also designed as a replacement fitting and it must be replaced due to retooling, it can be expedient if it is possible to remove the glue roll at the top of the mounting essentially only laterally, and if, during the removal or the insertion, the glue roll does not have to be lifted or lowered a substantial vertical distance.

BRIEF DESCRIPTION OF THE DRAWINGS

Embodiments of the object of the disclosure are explained on the basis of the drawings. Shown are.

DETAILED DESCRIPTION OF THE PREFERRED EMBODIMENTS

Figure 1:
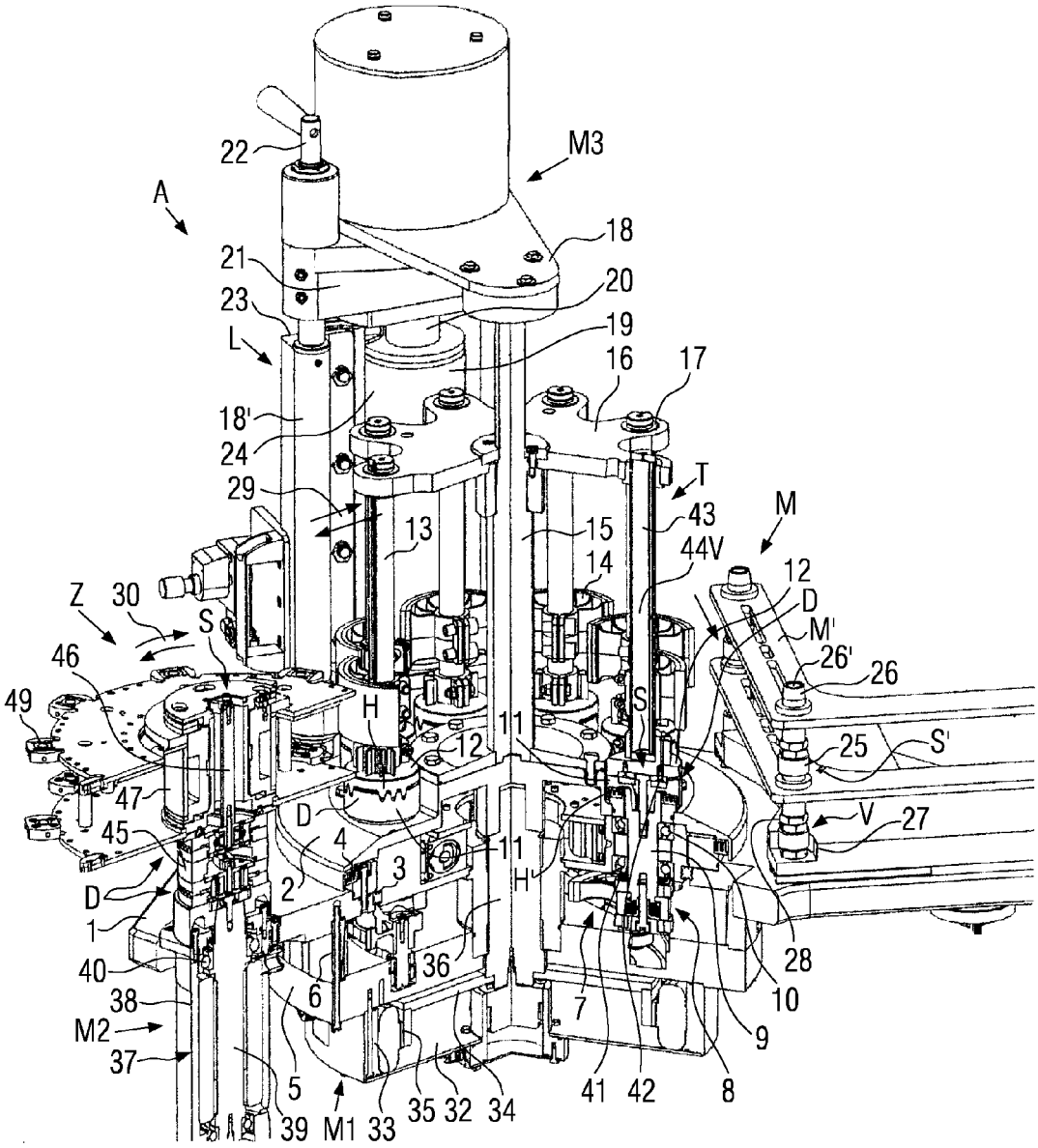
FIG. 1 a sectional depiction, in a perspective view from above diagonally, of a labelling assembly in which, as a possible design variant, a shared support structure is provided for functionally cooperating components, FIG. 2 a perspective depiction of the labelling assembly of FIG. 1, FIG. 3 a perspective depiction of a replacement fitting in the form of a pallet shaft equipped with a pallet, and FIG. 4 a development drawing of a pallet surface with a groove structure with an optimized surface.

FIG. 1 shows main components of an embodiment of a labelling assembly A, particularly of a cold glue labelling assembly for labelling fittings for the labelling of containers, such as plastic or glass bottles (not shown), that are, in a standing position, moved past the labelling assembly. Although in the depicted embodiment the main components are mounted on a common support structure 1, for example, a steel plate, the main components could also be independent functional units, each on its own support structure (not shown).

The central main component of the labelling assembly A of FIG. 1 is a transfer module T with an essentially vertical transfer axis, whereby this transfer module T takes labels individually out of a label magazine M that is connected to the support structure 1 and transfers them to a gripper cylinder Z that is on the support structure 1 and that further conveys the labels and applies them to containers, which are not shown. In the shown embodiment, the main components work in only a single plane. Alternatively, the main components could work in a plurality of planes, one above the other, in order to process different labels simultaneously (e.g., body labels, neck labels or mouth fittings).

A further main component on the support structure 1 is a glue unit L that provides the glue required for the application of the labels and that cooperates with the transfer module T.

Of a respective label magazine M, magazine carriers M' are indicated that can hold a plurality of magazines, stacked one above the other, and in which labels are held available in a stacked form, from which the transfer module T removes and transfers a single one in each level. The configuration of the labelling assembly A is known per se, but differs from known labelling assemblies in that for a replacement made necessary by a retooling (change in the type of label, change in the container dimensions, change in the container division, and the like), as is likewise known per se, removable and attachable replacement fittings are arranged and replaceable in an innovative manner.

In a central section of the support structure 1, a plate-shaped hub 2 of the transfer module T is rotatably supported unbound in the centre but supported near the outer circumference via a bearing-ring-free four-point moment support element 3, said hub being sealed along the circumference by means of a labyrinth seal 4. Provided on the bottom side of the support structure 1 via clamp bolts 6 is a support plate 5 of a lantern wheel 7 arranged underneath the hub 2, said lantern wheel 7 having pinions, teeth, toothed segments and the like, provided for the rotational driving of rotatably supported pallet shafts 13 in the tube 2 that rotate with the rotationally-driven hub 2. For each pallet shaft 13, an overload clutch 8 can optionally be provided within the lantern wheel 7, whereby this overload clutch 8 allows individual switching (passivation) of the pallet shaft 13 during operation, in a manner similar to that in the complete disclosure of DE 32 16 138 A, which is hereby incorporated. In concrete terms, the shown overload clutch 8 works with spring-preloaded balls.

Preferably supported in the hub 2 by means of roller bearings 10 is a vertical drive shaft 9 for each pallet shaft 13, whereby this drive shaft 9 leads to a ring flange 11 that projects on the upper side of the hub 2, whereby this ring flange 11 is sealed inwards by means of a labyrinth seal 11'. The respective pallet shaft 13 is in a drive connection with the ring flange 11 in a flush manner, centred over a rotating joint D, whereby a further ring flange 12 is arranged on the lower end of the pallet shaft 13. Both ring flanges 11, 12 form rotating joint halves H that are compatible with each other. The respective rotating joint D is explained in detail on the basis of FIG. 3. Its main characteristic is that it can be disengaged and engaged by means of an essentially, to the greatest possible extent only horizontal and lateral relative movement or tipping movement (arrows 29) of the pallet shaft 13, and, that in the full engagement position shown, it transmits torque without play from the drive shaft 9 on to the pallet shaft 13.

For each rotating joint D of a pallet shaft 13, a magnetic axial securing element S is expediently provided that fixes the rotating joint D in the full engagement position only in such a manner that in the event of a replacement, the axial securing element is brought into a release position solely by the lateral tipping-away of the upper end of the pallet shaft 13 (arrows 29) and that the rotating joint D can be disengaged in order to take the pallet shaft 13 out of the transfer module T to the side without it being necessary to lift it upwards. In FIG. 1, the axial securing element S of each rotating joint D of a plate shaft 13 is constituted by, for example, a ferromagnetic or magnetic plate 41 in a lower ring flange 11 and a flat ring-shaped magnet or individual permanent magnets 42 distributed across the circumferential direction in the upper ring flange 12. It would also be possible for two permanent magnets 42 to interact axially.

At least one pallet shaft 13 carries at least one pallet 14 in a predetermined relative axial and defined rotational position. Extending upwards from the center of the hub 2 is a shaft 15 on which is arranged, in a manner that allows it to be slid vertically, a cover plate 16 having cuts on the edges, in which cover plate, in the operating position shown in FIG. 1, the upper ends of the pallet shafts 13 and 17 are supported in a rotatable manner. In the event that the labelling assembly A is standing still, the cover plate 16 can be lifted upwards and, where applicable, rotated around a division of the cuts along the edges, so that the upper ends of the pallet shafts 13 lie free and these can be tipped laterally in the direction of the arrows 29 in order to disengage the respective rotating joint D and replace the pallet shaft. The central shaft 15 of the hub 2 extends upwards into a bearing console 18, here, for example, of the glue unit L that is mounted in a stationary manner on the support structure 1.

Arranged in a rotatable manner in the glue unit L is a cylindrical glue roll 19, that is accessible to surfaces of the pallets 14 that pass by in an opening 24 which faces towards the transfer module T and which belongs to an all-embracing housing 23 of the glue unit L. An upper top end 20 of the glue roll 19 is supported rotatably in a mounting 21 that is supported on the support structure 1 in a stationary manner, for example, by means of telescopic columns 18': the top end is in a drive connection with a direct drive motor M3 that is placed upon the mounting 21. A clamping device 22 allows, for example, the glue roll 19 to be pulled upwards together with the direct drive motor M3, which, preferably, can be an electric servomotor. Alternatively, it could also be possible to dismantle and laterally remove the glue roll 19 from the mounting 21 at the top end, if necessary, because it is supported in the mounting 21 in a suspended and overhung manner, so that glue applied to the glue roll 19 is able to flow off downwards and be conducted away without endangering the drive elements or sealed areas. Furthermore, at least one glue-spreading knife or doctor blade and a glue supply for the glue roll 19 could be contained in the glue unit L.

For the magazine M or the respective magazine carrier M', a plurality of detachable connections V are provided in FIG. 1 distributed along the circumferential direction at supports, each stationary, on the support structure 1 or a lower magazine M. Each connection V consists of a cone pin 26 on the upper side of the support structure 1 or on the upper side of a magazine carrier M', which is inserted into a compatible cone sleeve 25 which is mounted on the bottom side of each magazine carrier M', for example, by means of adjustment nuts 28. The insertion depth corresponds, e.g., approximately to the average engagement diameter of the cone pin 26 or is even less than this. Magazine carriers M' are shown in a plurality of levels in FIG. 1. It is also possible that only one is provided. The height adjustment and fixation of each cone pin 26 on the support structure 1 is accomplished, for example, by means of a clamping nut 27. In the embodiment shown in FIG. 1, the respective magazine M or the magazine carrier M' is also a replacement fitting of the labelling assembly A that can be exchanged in the event of a replacement made necessary by a retooling. All or some of the cone pins 26 can have an integrated magnet 26', which produces a magnetic axial securing with the cone sleeve 25 in the full engagement position. In the event of a replacement, each magazine carrier M' is lifted only the distance of the engagement depth between the cone pin 26 and the cone sleeve 25 by disengaging the magnetic axial securing, and is then moved away to the side, before a new magazine carrier M' or a new magazine M is mounted in the reverse order. The connections V for the magazine or for the magazine carrier M, M' are fashioned expediently in such a manner that each cone pin 26 points upwards and the cone sleeves 25 are placed on to the cone pins 26 from above. An installation in the reverse position is also possible, however.

A direct drive motor M1 is mounted on the bottom side of the support structure 1 or of the support plate 5 for the hub 2 of the transfer module T and for the lantern wheel 7. In the shown embodiment, the direct drive motor M1 is an electric torque motor 32 with a stationary, coil-containing stator 33 and an interior ring armature 34 that is equipped with magnet (s) 35 and that directly drives a central, vertical shaft 36 of the hub 2.

The gripper cylinder Z is likewise a replacement fitting and can be replaced with another gripper cylinder Z in the event of a replacement made necessary by a retooling. A direct drive motor M2, preferably an electric servomotor 37, is mounted on the bottom side of the support structure 1 for the gripper cylinder Z, whereby this motor has a stationary motor housing 38 with an interior coil and an inner, vertical drive shaft 39 for a rotor 47 of the gripper cylinder Z. The drive shaft 39 is supported in roller bearings 40 in a manner that allows rotation, and it extends upwards up to the upper side of the support structure 1 to a first rotating joint D that can be of the same type or similar to the rotating joints D of the pallet shafts 13 and, optionally, in the shown embodiment, is connected via a spacer 45 to a second rotating joint D that connects the drive shaft 39 to the rotor 47 of the gripper cylinder Z. Provided on the gripper cylinder rotor 47 around the circumference are attachment devices 48 for gripper components that are not shown in FIG. 1.

Furthermore, an axial securing element S is provided in each rotating joint D for the gripper cylinder Z, whereby this axial securing element S fixes the rotating joint D in the full engagement position. In the case of the gripper cylinder Z, the axial securing element for, for example, the upper rotating joint D has a form-fit (e.g., as a clamping screw, bayonet catch or with locking elements that can be adjusted from above), or is formed in such a manner that the axial securing element optionally works in a magnetic manner, but can be brought from the shown holding position into a release position by means of a connection element 46 that can be activated from above, whereby in the release position the rotating joint D can be disengaged by means of an essentially, to the greatest possible extent horizontal and lateral tipping movement (arrows 30) for the lateral removal or attachment of the gripper cylinder Z without having to lift the gripper cylinder Z upwards.

Figure 2:
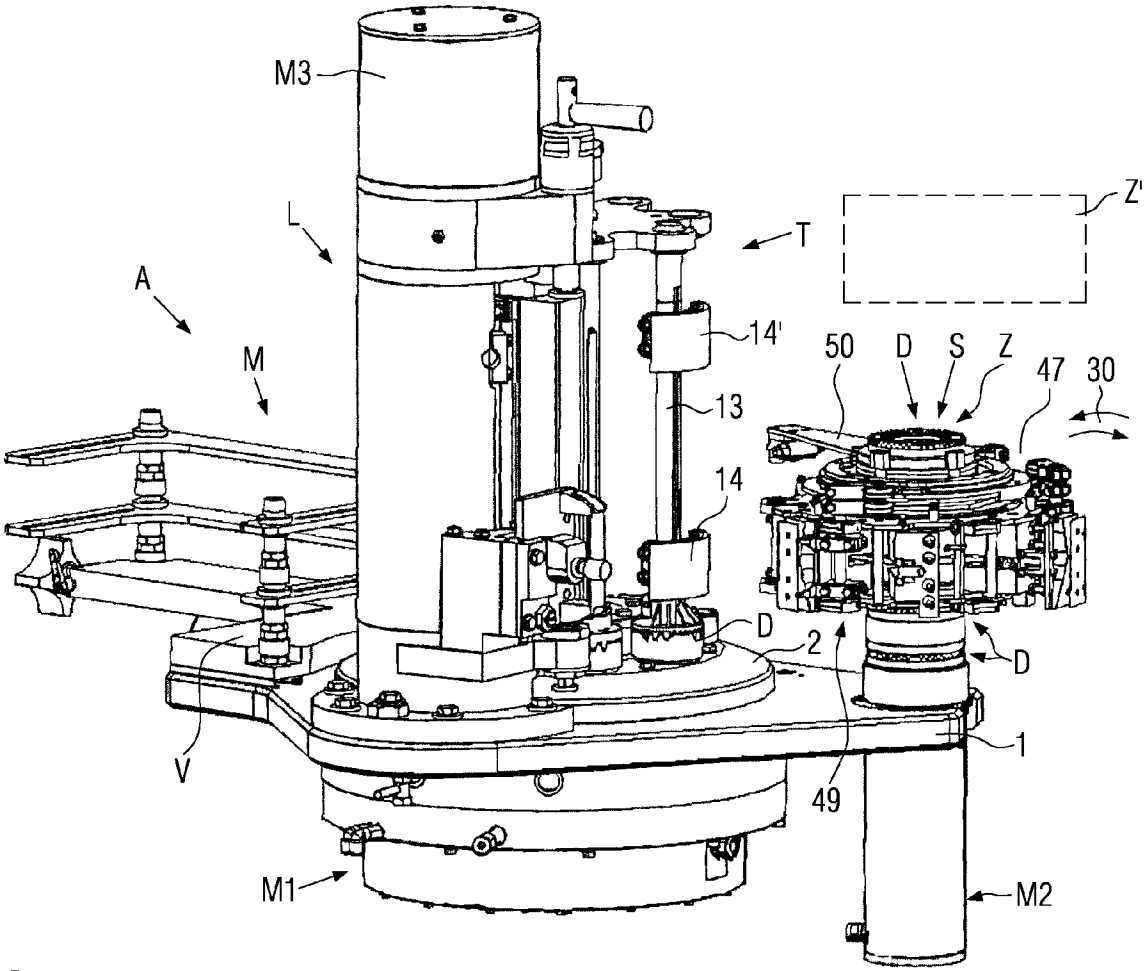

FIG. 2 shows the labelling assembly A, for example, from FIG. 1, in a perspective view from a line of sight that differs from that of FIG. 1. Two pallets 14, 14' are shown in the transfer module T, mounted one above the other on the one shown pallet shaft 13. The upper pallet 14' is used, for example, in order also to process an upper label simultaneously. The gripper cylinder Z here is used only for taking over the labels delivered by the lower pallets 14 by means of its grippers 49 and is supported above the direct drive motor M2 by the two coaxial rotating joints D already shown in FIG. 1, so to say on a central rotating column on the support structure 1. A torque take-up support 50 is provided for the positioning of control cams, which are not emphasised in more detail, for gripper control and, where applicable, also for the stabilization of the gripper cylinder Z during operation. Shown at the upper end of the gripper cylinder rotor 47 is a rotating joint half that can be used for placing a further gripper cylinder Z' (indicated with dashes) that is used for the removal of the labels delivered by the upper pallets 14'. Access for the activation of the axial securing element S for a replacement of the gripper cylinder Z is given at the upper end of the rotor 47, whereby the gripper cylinder Z is removed or inserted after the removal or with the torque take-up support 50 as a replacement fitting with a lateral and essentially, to the greatest possible extent horizontal tipping movement (arrows 30) via the at least one rotating joint D.

Figure 3:
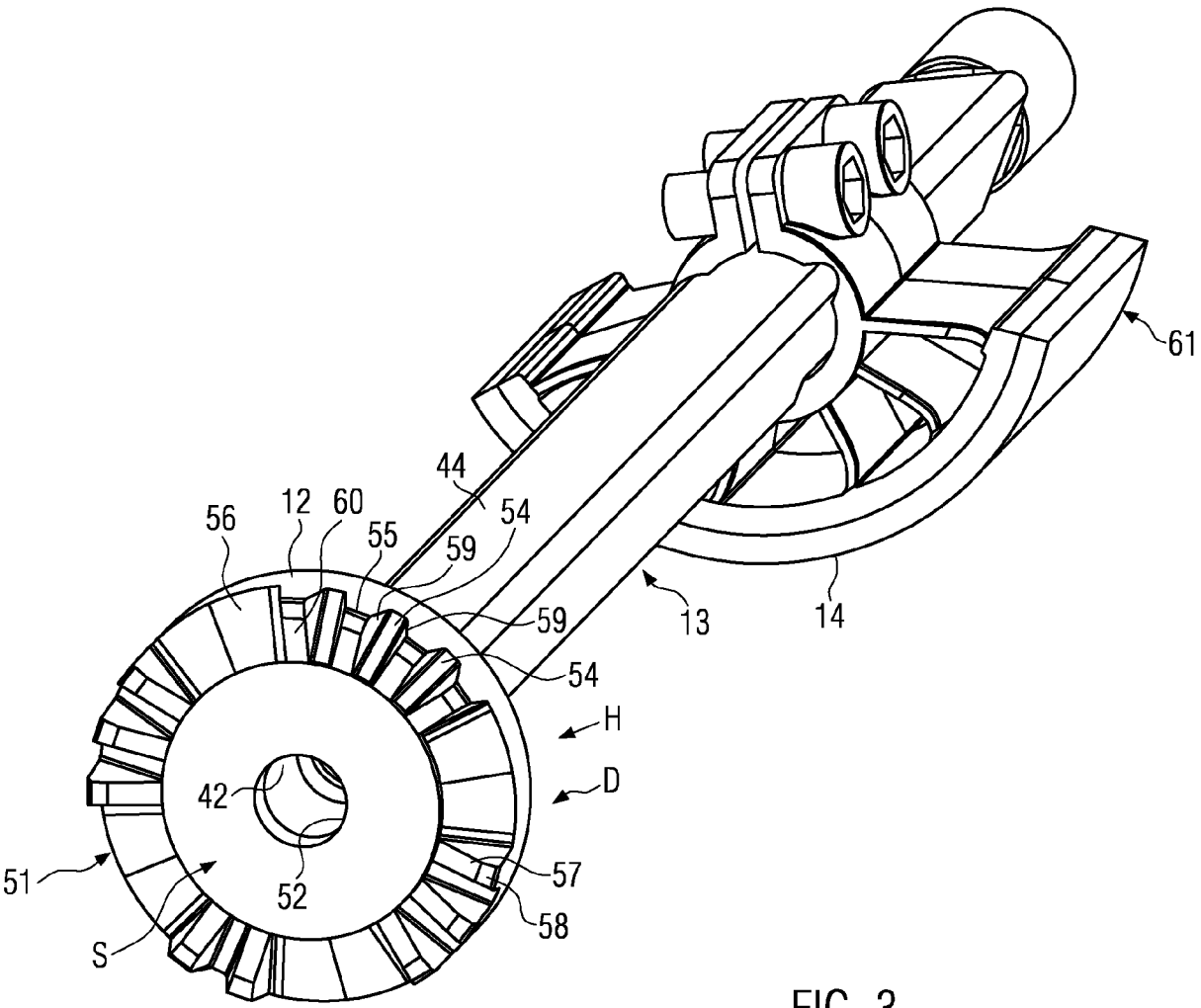

FIG. 3 illustrates another embodiment of a replacement fitting in the form of a pallet shaft 13 with a rotating joint half H of the rotating joint D on the ring flange 12, which is mounted on the lower end of the pallet shaft 13. In this embodiment, the pallet shaft 13 has, for example, an approximately triangular outer cross-section for the proper rotational positioning of the pallet 14, which transfers labels with its pallet surface 61. The position of the height of the pallet 14 along the pallet shaft 13 is adjustable.

Each rotating joint half H of the rotating joint D has a frontal toothed ring 51 that is formed with a circular shape in the circumferential direction, e.g., around a central free area 52, for example, in the outer circumferential area and on the front side of the ring flange 32. Mounted in the free area 52 is, for example, a permanent magnet annulus disk 42 (see FIG. 1) that is a part of the here, for example, magnetic axial securing element S that, in the full engagement position of the rotating joint, pulls the two joint halves H to each other and secures them.

In FIG. 3, each frontal toothed ring 51 has a plurality of radially oriented teeth 54 and tooth spaces 55, whereby in the shown embodiment, the teeth 54 and the tooth spaces 55 form four groups, distributed across the circumferential direction, of three/three/three/two equal teeth 54, and four toothless broad tooth spaces 56. The distribution of the teeth 54 and the tooth spaces 55 is irregular and is chosen such that between the two rotating joint halves H in the full engagement position of the rotating joint D, only a single predetermined relative rotational position is possible, which is important, for example, for the pallet shaft 13 in order that this, equipped with at least one pallet 14, has, after the insertion, the correct rotational position in the lantern wheel 7 with respect to the drive shaft 9. Alternatively (not shown), equal teeth or tooth spaces 54, 55 can be distributed regularly in the circumferential direction. At least one additional positioning device, such as, e.g., a centering pin and a centering pin receiving element then ensures the single relative rotational position between the two frontal toothed rings 51 in the engagement position.

For the case in which having only one correct relative rotational positioning in the rotating joint D is not an issue, which, for example, can apply to the gripper cylinder Z, the cogged frontal toothed rings 51 can be formed in a periodic manner and fit one into the other in different relative rotational positions.

An important feature of the frontal toothed rings 51 that are compatible with one another consists of the fact that flanks 59 and the tooth ridge 57, 58 of each tooth 54 are spatially diagonally sloped, so that the rotating joint D functions simultaneously as a centering device in the full engagement position and between coupled shafts. Consequently, inner sections 57 of the ridges 58 fall away inwards diagonally in the direction of the tooth root, as do also the flanks 59, which are cocked symmetrically away from the tooth ridges 57, 58 in the direction towards the tooth root such that the distance between the flanks 59 of each tooth 54 increases in the direction towards the tooth root. The tooth spaces 55 can also, as indicated in 60, run diagonally in the radial direction towards the rotating joint axis. The other rotating joint half H that is not shown in FIG. 3 can be formed in the same manner. A prominent characteristic of this rotating joint D is that in the full engagement position, it is capable of transmitting high torque without play and it additionally provides precise centering, e.g., between the pallet shaft 13 and the drive shaft 9 or the ring flanges 11, 12, but can thereby be engaged and disengaged by means of the tipping movement of a shaft crosswise to the rotating joint axis without considerable vertical travel in the direction of the rotating joint axis.

The pallet shaft 13 shown in FIG. 3 is, for example, a carbon fiber reinforced molded part or a stainless steel hydroform pipe part, i.e., it is hollow but nevertheless dimensionally stable in order to save weight. The pallet 14 can also be a plastic molded part, for example, a two-component injection-molded part in order to save weight, whereby either the pallet surface 61 is fashioned with a groove structure as shown in FIG. 4 during the injection molding process or the groove structure is produced at a later time in a surface-optimized manner, for example, by means of laser ablation, in order to take away exactly as much glue from the glue roll 19 as is needed for the proper adhesion of a label.

Figure 4:
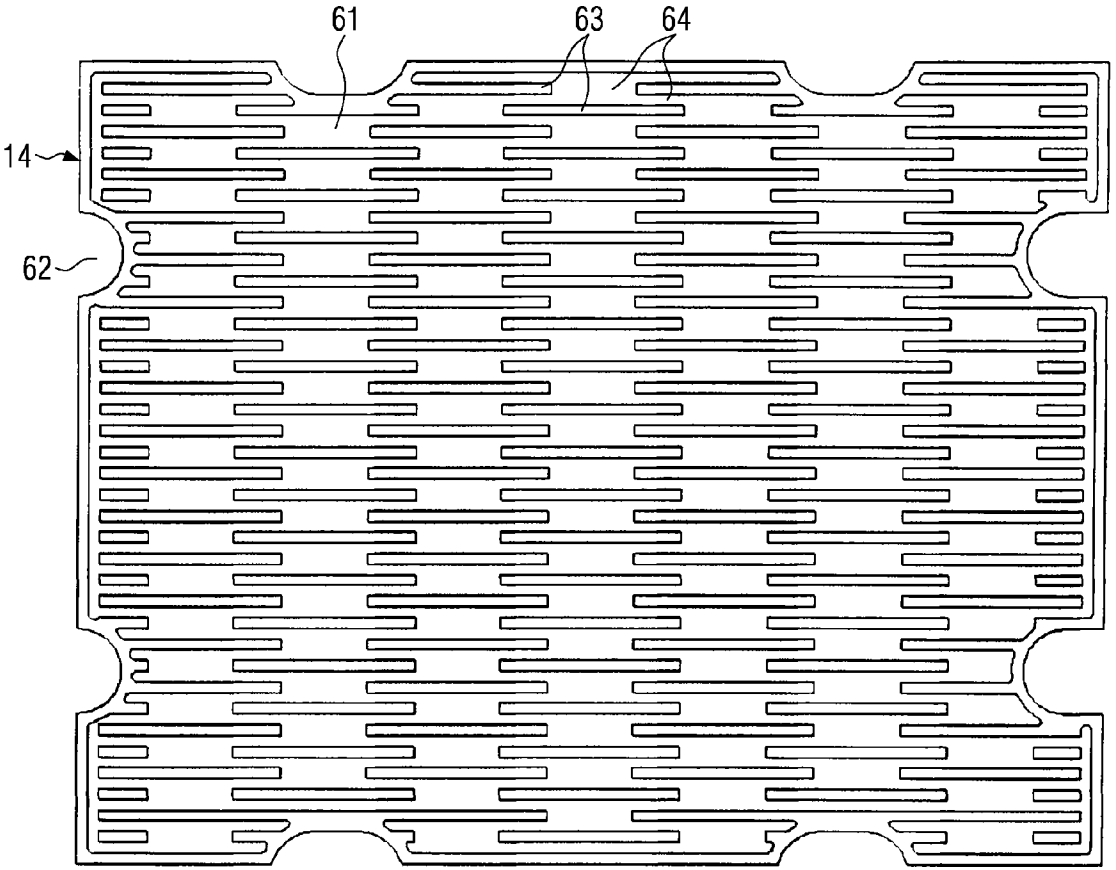

FIG. 4 shows a development drawing of an embodiment of a pallet surface 61 that bears a groove structure, whereby this pallet surface 61 here is rectangular and has on at least one edge at least one lateral cut 62 for the engagement of at least one gripper finger of the grippers 49 (FIG. 2) of the gripper cylinder Z, to assure a glue-free edge area of a label. In the shown embodiment, two such cuts 62 are formed along each side edge of the pallet surface 61. The groove structure of the pallet surface 61 features, for example, straight ridges 63 that overlap one another at a distance and recesses 64 lying in between and connected to one another within the entire groove structure, said recesses 64 being formed, for example, by means of laser ablation. Only the ridges 63 are given a glue application when the pallet surface 61 rolls on the glue roll 19.

What is claimed is:

1. A labelling assembly, comprising a transfer module on a rotationally driveable hub, the transfer module having at least one essentially vertical pallet shaft that can be driven rotationally, the pallet shaft carrying at least one pallet and also being configured for connection to at least an essentially vertical glue roll, at least one label magazine, and a gripper cylinder that can be driven rotationally around an at least essentially vertical axis, wherein at least the pallet shaft and/or the magazine and/or the gripper cylinder and/or the glue roll are replacement fittings connected detachably to a respective support for replacement due to retooling, and wherein the respective connection of at least one replacement fitting with the associated support is formed such that the replacement fitting can be removed and attached by means of an essentially largely horizontal and lateral movement relative to the support, wherein a replacement fitting is rotationally driven via a drive shaft, and a connection to said drive shaft via a torque transmitting rotating joint can be engaged and disengaged by means of a horizontal sideward tipping movement of the replacement fitting.

2. The labelling assembly according to claim 1, wherein the rotating joint is a Hirth coupling.

3. The labelling assembly according to claim 1, wherein the rotating joint comprises two frontal toothed rings that fit one inside the other.

4. The labeling assembly according to claim 3, wherein each frontal toothed ring of a rotating joint half is arranged concentric with the axis of the rotating joint.

5. The labelling assembly according to claim 4, and further wherein each frontal toothed ring is arranged around a central free area in the interior of the rotating joint.

6. The labelling assembly according to claim 5, wherein the central free area is spherical.

7. The labelling assembly according to claim 3, wherein the two frontal toothed rings are structured equally.

8. The labelling assembly according to claim 1, wherein in a full engagement position, the rotating joint additionally forms a centering device between the shafts that are coupled during the torque transmission.

9. The labelling assembly according to claim 1, wherein the rotating joint can be brought into a full and no-play engagement between a shaft of the replacement fitting and the drive shaft in only a single relative mutual rotational positioning between engaging frontal toothed rings of the rotating joint.

10. The labelling assembly according to claim 9, wherein each frontal toothed ring has in the circumferential direction either irregularly distributed teeth and tooth spaces or uniformly distributed, equal teeth or tooth spaces and at least one additional positioning device for a predetermined engagement position of the frontal toothed ring, and wherein the teeth have, in the radial and axial directions, diagonal flanks and tooth ridges the distance, measured in the circumferential direction, between the diagonal flanks of each tooth increases symmetrically from the tooth ridge in the direction towards the tooth root in the axial direction, and at least one section of the tooth ridge declines in the radial direction inwards in the direction towards the tooth root.

11. The labelling assembly according to claim 1, wherein a force-fit and/or form-fit axial securing element is provided in the rotating joint between frontal toothed rings at least in the full engagement position of the rotating joint.

12. The labelling assembly according to claim 11 and further comprising a magnetic axial securing element that can be adjusted from a holding position into a release position by means of the essentially horizontal and lateral tipping relative movement during the removal of the replacement fitting.

13. The labelling assembly according to claim 11, and comprising further a magnetic axial securing element with two magnets that attract each other or an attracting magnet and a ferromagnetic or magnetic counterpart , wherein the magnet or the counterpart can be adjusted by means of the activation of a connection element that is predominantly axially adjustable from a holding position into a release position of the axial securing element.

14. The labelling assembly according to claim 11, wherein the axial securing element that is to be activated before the removal or after the insertion of the replacement fitting has a form-fit and comprises a clamping screw or wedge-shaped locking elements that are controlled by an axial rotational movement and that can be slid radially or by a bayonet coupling.

15. The labelling assembly according to claim 1, wherein the transfer module hub, which supports a plurality of pallet shaft-rotating joint halves that are coupled to a shared lantern wheel in a manner that allows rotation, is in a drive connection with a direct drive motor that is mounted on the bottom side of a stationary support structure, the direct drive motor having a stationary, coil-containing stator and an interior ring armature that is equipped with a magnet and is directly connected with the hub.

16. The labelling device according to claim 15, wherein the hub is centrally and rotatably supported in the support structure in an unbound manner close to the outer hub circumference via a bearing-ring-free four-point moment support element.

17. The labelling assembly according to claim 15, wherein the direct drive motor comprises an electric torque motor.

18. The labelling assembly according to claim 1, wherein the drive shaft is for the pallet shaft or the gripper cylinder.

19. The labelling assembly according to claim 1, wherein each connection between the replacement fitting that is formed by a magazine or a magazine carrier, and a respective stationary support is formed by a cone pin inserted into a cone sleeve, wherein, the mutual axial engagement depth between the cone pin and the cone sleeve corresponds to only roughly the average engagement diameter or is less than this and wherein, the cone tip angle amounts to between approximately 5° and 15°.

20. The labelling assembly according to claim 19, and wherein a plurality of connections, each with a cone pin and a cone sleeve, are provided in the circumferential direction of the magazine or of the magazine carrier, each with an, magnetic axial securing element between the cone sleeve and the inserted cone pin.

21. The labelling assembly according to claim 19, wherein, in the case of a plurality of magazines or magazine carriers stacked one above the other, the respective upper one is positioned upon the lower one via at least one connection of a cone pin and a cone sleeve in such a manner that it can be removed and placed, and can be removed or attached by an axial lifting or placing movement that only covers the distance of the engagement depth and by a horizontal lateral movement.

22. The labelling assembly according to claim 1 wherein each pallet (14) is manufactured of plastic.

23. The labelling assembly according to claim 22, wherein each pallet manufactured of plastic comprises a two-component injection molded part.

24. The labelling assembly according to claim 22, and a pallet surface bears a varying groove structure between one another overlapping straight ridges.

25. The labelling assembly according to claim 24, and wherein the varying groove is produced by means of laser ablation.

26. The labelling assembly according to claim 1, wherein the pallet shaft has, at least in axial sections, a pipe-like cross-section.

27. The labeling assembly according to claim 26, wherein the pallet shaft is formed as a carbon fiber reinforced molded part or stainless steel hydroform pipe part.

28. The labelling assembly according to claim 27, wherein the pallet shaft bears on the lower end a rotating joint half on an end flange having a diameter that is greater than that of the pallet shaft.

29. The labelling assembly according to claim 26, and wherein the pallet shaft has, at least in axial sections, a non-circular outer cross-section.

30. The labelling assembly according to claim 29, wherein the non-circular outer cross-section is triangular.

31. The labelling assembly according to claim 1 characterised in that the gripper cylinder is in a drive connection, via at least one rotating joint that can be disengaged and is rotatably supported on the support structure, with a drive shaft of a direct drive motor that is mounted on the bottom of a support structure.

32. The labelling assembly according to claim 31, wherein the direct drive motor comprisesan electric servomotor.

33. The labelling assembly according to claim 31, wherein the support structure comprises a common support structure of the gripper cylinder and of the at least one transfer module.

34. The labelling assembly according to claim 1, and a glue unit, which contains the glue roll, the transfer module, the gripper cylinder and the magazine or the respective magazine carrier are mounted on a common support structure, which is formed as a plate.

35. The labelling assembly according to claim 34, wherein the glue roll, on a top end thereof that lies above the support structure, is supported rotatably in a suspended and overhung manner in a mounting, the mounting being supported on the support structure, and that the glue roll is in a direct drive connection with an electric servomotor that is placed on the top of the mounting.

36. The labelling assembly according to claim 35, and wherein the glue roll can be laterally disassembled from the glue unit at the top end from or together with the mounting.

37. The labeling assembly according to claim 1, wherein the labeling assembly is for the continuous labeling of containers with individual glued fitting labels.

* * * * *